United States Patent [19]

Freno et al.

[11] Patent Number: 4,591,521

[45] Date of Patent: May 27, 1986

[54] THREE DIMENSIONAL FABRIC DESIGN

[76] Inventors: Helen Freno; John S. Freno, both of 168 Nehring Ave., Staten Island, N.Y. 10314

[21] Appl. No.: 750,738

[22] Filed: Jul. 1, 1985

[51] Int. Cl.[4] ..... B44C 1/18

[52] U.S. Cl. ..... 428/78; 2/80; D2/81; 428/16

[58] Field of Search ..... D2/80, 81; 2/9, 80, 2/115, 206; 428/16, 78, 79

[56] References Cited

U.S. PATENT DOCUMENTS

| | | | |
|---|---|---|---|
| 2,630,574 | 3/1953 | Malarkey | 428/79 X |
| 2,693,221 | 11/1954 | Lyijynen | 428/158 X |
| 2,705,803 | 4/1955 | Sheldrick et al. | D2/81 X |
| 3,295,529 | 1/1967 | Corrigall et al. | 428/102 X |
| 3,318,636 | 5/1967 | Callum | 428/160 X |
| 3,354,020 | 11/1967 | Copeland | 428/86 |
| 4,040,881 | 8/1977 | Wallace | 156/213 X |
| 4,474,725 | 10/1984 | Sands | 428/79 X |
| 4,514,175 | 4/1985 | Zaruba et al. | 428/542.2 X |

*Primary Examiner*—Henry F. Epstein

*Attorney, Agent, or Firm*—Richard L. Miller

[57] ABSTRACT

This invention is a tee-shirt, garment or other fabric device that includes an outer panel having at least one pocket therebehind and a contoured foam plastic pad inside the pocket bulging outwardly to create a three dimensional appearance.

6 Claims, 4 Drawing Figures

THREE DIMENSIONAL FABRIC DESIGN

BACKGROUND OF THE INVENTION

This invention relates generally to decorative fabrics. More specifically it relates to fabric having three dimensional designs thereupon.

It is well known that numerous novelty fabrics have been developed in the past in order to attract the attention of observers to something now in the field. Heretofore all attempts in the production of a new three dimensional effect for fabric design was done only through graphics, and not structurally.

SUMMARY OF THE INVENTION

Accordingly it is a principal object of the present invention to provide a fabric that includes designs thereupon that are made actually three dimensional structurally for a more realistic appearance.

Another object is to provide a three dimensional fabric design that would be particularly appealing to the buying public in the manufacture of novelty garments such as for example: tee-shirts, comforters, wearing apparel in general, or the like.

Yet another object is to provide a three dimensional fabric design which is produced by a foam plastic pad being pocketed behind the fabric for forming the three dimensional effect.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
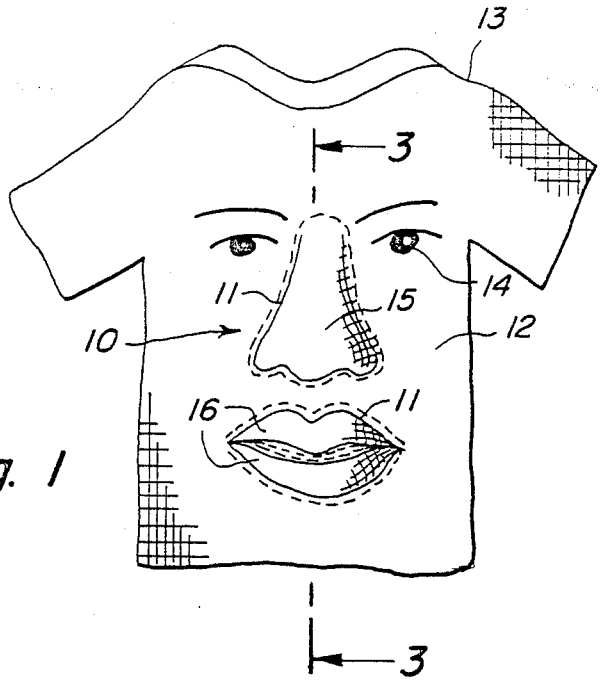
FIG. 1 is a front view of a typical garment with the invention installed thereon.
Figure 2:
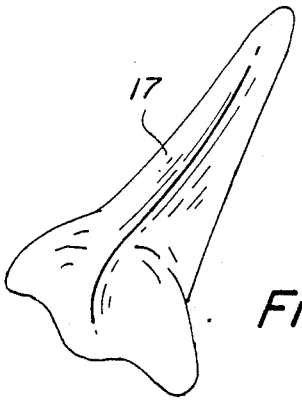
FIG. 2 is a perspective view of a typical foam insert component of the invention.
Figure 3:
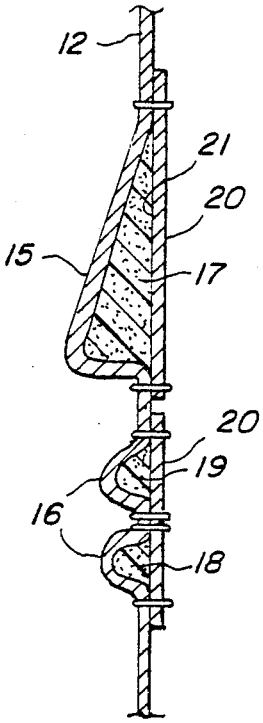
FIG. 3 is a cross sectional view taken on line 3—3 in FIG. 2.
Figure 4:
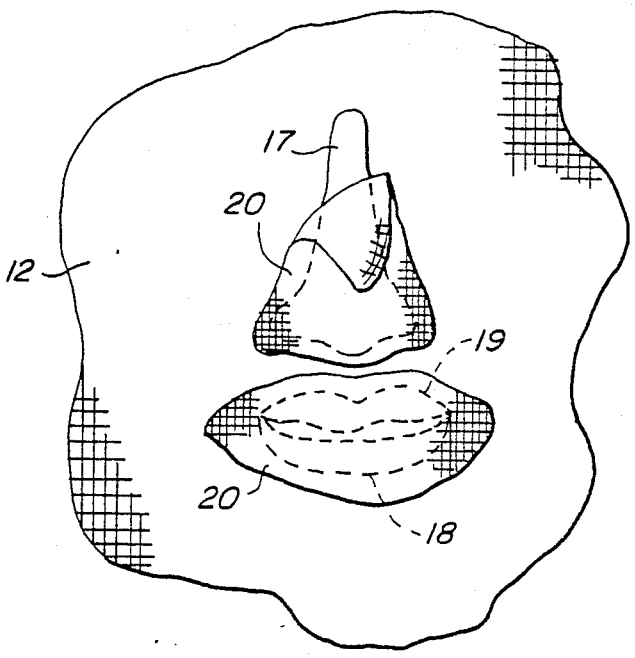
FIG. 4 is a partial rear view of the back surface of the fabric broken open showing the invention installed therein.

Referring now to the drawing in greater detail, the reference numeral 10 represents a three dimensional fabric design according to the instant invention wherein the same is made by initially printing a design outline 11 upon a front side of a fabric material. In the example illustrated in the drawing, the fabric comprises a front panel 12 of a tee-shirt 13, and the design comprises eyes 14, nose 15 and upper and lower lips 16. In this illustrated example, the nose and the lips are made to be three dimensional by cutting and contouring a piece of foam plastic pad 17 into a three dimensional nosepiece, as shown in FIG. 2, and which fits the printed outline on the fabric. Another foam plastic pad 18 is shaped to the outline of the printed lower lip, and still another pad 19 is contoured to outline of the printed upper lip. A rear fabric panel 20 is stitched to a rear side of the front panel and is located directly behind each of the designs 15 and 16 so as to form pockets 21 therebetween. The contoured pads 17, 18 and 19 are then each fitted snugly into their own respective pocket. Finally the front and rear panels are then stitched together close around a perimeter of each of the pads which causes the pad to bulge forwardly and produce a three dimensional effect on the front side of the front fabric panel, as shown.

Accordingly although stitching is illustrated as the principle method of securing the fabric it is to be noted that there are many other methods of securement such as heat sealing with a suitable bonding agent, cementing, etc. which are well known to those skilled in the art.

While the design shown in the drawing is that of a face upon a tee-shirt, it may otherwise be made to represent any other object, as wished upon an infinite variety of garments, wearing apparel, blankets, or what ever.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A three dimensional fabric design, comprising in combination:

(a) a front fabric panel which is part of a wearing apparel;

(b) a rear fabric panel forming a patch on a rear side of said front fabric panel;

(c) a pocket formed between said panels;

(d) a three dimensionally contoured foam plastic pad contained within said pocket and causing said front fabric panel to conform to its contour, said rear fabric panel being located only behind the pad; and (e) means for securing said front fabric panel to said rear fabric panel around the perimeter of the pad.

2. The combination as set forth in claim 1, wherein said means for securing is a row of stitches between said panels.

3. The combination as set forth in claim 1, wherein said means for securing said panels is a heat sealing process.

4. The combination as set forth in claim 1, wherein said means for securing said panels is a cementing process.

5. The combination as set forth in claim 2, wherein said front panel comprises a panel of a comforter blanket.

6. The combination as set forth in claim 2, wherein said front panel comprises a panel of a tee-shirt garment.

* * * * *